US008757385B2

(12) United States Patent
Goel et al.

(10) Patent No.: US 8,757,385 B2
(45) Date of Patent: Jun. 24, 2014

(54) PACKAGING FOR ELECTRICAL EQUIPMENT

(75) Inventors: Amit Goel, Westminster, CO (US); Ronald S. Rozensky, Bradenton, FL (US); Ernest Lee Shero, McKinney, TX (US); Michael James Krack, Saint Petersburg, FL (US)

(73) Assignee: Avaya Inc., Basking Ridge, NJ (US)

( * ) Notice: Subject to any disclaimer, the term of this patent is extended or adjusted under 35 U.S.C. 154(b) by 1209 days.

(21) Appl. No.: 11/691,444

(22) Filed: Mar. 26, 2007

(65) Prior Publication Data

US 2008/0236099 A1 Oct. 2, 2008

(51) Int. Cl.
*B65D 85/86* (2006.01)

(52) U.S. Cl.
USPC ..... 206/701; 206/320

(58) Field of Classification Search
USPC ..... 206/701, 320, 723, 722, 706, 721; 439/822, 829; 324/508; 53/139.4, 167
See application file for complete search history.

(56) References Cited

U.S. PATENT DOCUMENTS

| | | | | | |
|---|---|---|---|---|---|
| 2,763,707 | A * | 9/1956 | Soderberg | 206/702 |
| 3,093,243 | A * | 6/1963 | Petter | 206/728 |
| 3,322,321 | A * | 5/1967 | Nurre et al. | 206/599 |
| 3,669,259 | A * | 6/1972 | Brandi | 206/727 |
| 4,041,380 | A * | 8/1977 | Epstein | 324/508 |
| 4,094,298 | A * | 6/1978 | Kober | 126/263.01 |
| 4,104,705 | A * | 8/1978 | Levand et al. | 362/5 |
| 4,423,732 | A * | 1/1984 | Tarjan et al. | 607/27 |
| RE33,402 | E * | 10/1990 | Thrush | 206/320 |
| 5,772,489 | A * | 6/1998 | Sherer et al. | 446/14 |
| 5,811,184 | A * | 9/1998 | Anderson et al. | 206/701 |
| 6,193,069 | B1 | 2/2001 | Guenther et al. | |
| 6,305,539 | B1 | 10/2001 | Sanders, Jr. | |
| 6,357,001 | B1 * | 3/2002 | Brower et al. | 206/720 |
| 6,422,669 | B1 * | 7/2002 | Salvatori et al. | 206/320 |
| 6,438,685 | B1 * | 8/2002 | Brower et al. | 206/720 |
| 6,683,250 | B2 * | 1/2004 | Luettgen et al. | 206/706 |
| 6,874,424 | B2 * | 4/2005 | Bailey et al. | 102/275.11 |
| 7,038,126 | B2 * | 5/2006 | Solet | 174/50 |
| 7,048,181 | B2 * | 5/2006 | Wang | 235/380 |
| 7,061,248 | B1 * | 6/2006 | Holland | 324/508 |

* cited by examiner

*Primary Examiner* — Andrew Perreault
(74) *Attorney, Agent, or Firm* — IP Spring

(57) ABSTRACT

Packaging for electrical equipment is disclosed in which metal electrically conductive staples are stapled—in contrast to tacked—through the packaging to provide an electrical path between the inside and the outside of the packaging. On the inside of the packaging, each staple clutches and is electrically connected to a wire that is connected to a jack on the electrical equipment. This provides an electrical path between the outside of the packaging and the electrical equipment. When the electrical equipment is to be tested or configured, the testing tool is connected to the staples on the outside of the packaging with spring-load clips. This provides as many electrical paths between the testing tool and the electrical equipment as necessary or desirable and for very little cost.

16 Claims, 4 Drawing Sheets

PACKAGING FOR ELECTRICAL EQUIPMENT

FIELD OF THE INVENTION

The present invention relates to packaging in general, and, more particularly, to packaging for electrical equipment.

BACKGROUND OF THE INVENTION

Electrical equipment is usually warehoused in its retail packaging. This is disadvantageous because the equipment must often be tested and configured after leaving the factory but before being delivered to the customer. In this case, the packaging is carefully opened, the equipment is removed, tested, configured, and put back, and the packaging is carefully resealed.

This process of opening the packaging, removing the equipment, and putting it back requires time and resources and often results in damage to the packaging and/or the equipment. When the process damages the equipment, the process is clearly disadvantageous, but when the process damages the packaging, the equipment cannot be sold without being returned to the factory and re-packaged. This is also disadvantageous. The need exists, therefore, for a solution to the problems associated with opening the packaging, removing the equipment, and putting it back.

SUMMARY OF THE INVENTION

The present invention enables the packaging of electrical equipment without some of the costs and disadvantages of packaging in the prior art. In particular, the present invention is an economical technique for testing, configuring, and using electrical equipment without removing it from its packaging. This is particularly useful for electrical equipment that is being warehoused and prepared for final delivery to customers.

In accordance with the illustrative embodiment, metal electrically conductive staples are stapled—in contrast to tacked—through the packaging to provide an electrical path between the inside and the outside of the packaging. On the inside of the packaging, each staple clutches and is electrically connected to a wire that is connected to a jack on the electrical equipment. This provides an electrical path between the outside of the packaging and the electrical equipment.

When the electrical equipment is to be tested, configured, or used, the testing tool is connected to the staples on the outside of the packaging with spring-load clips. This provides as many electrical paths between the testing tool and the electrical equipment as necessary or desirable and for very little cost.

The illustrative embodiment comprises: a piece of cardboard; a staple that is stapled to the piece of cardboard; and an insulated wire that is electrically connected to the staple.

DETAILED DESCRIPTION

Figure 1:
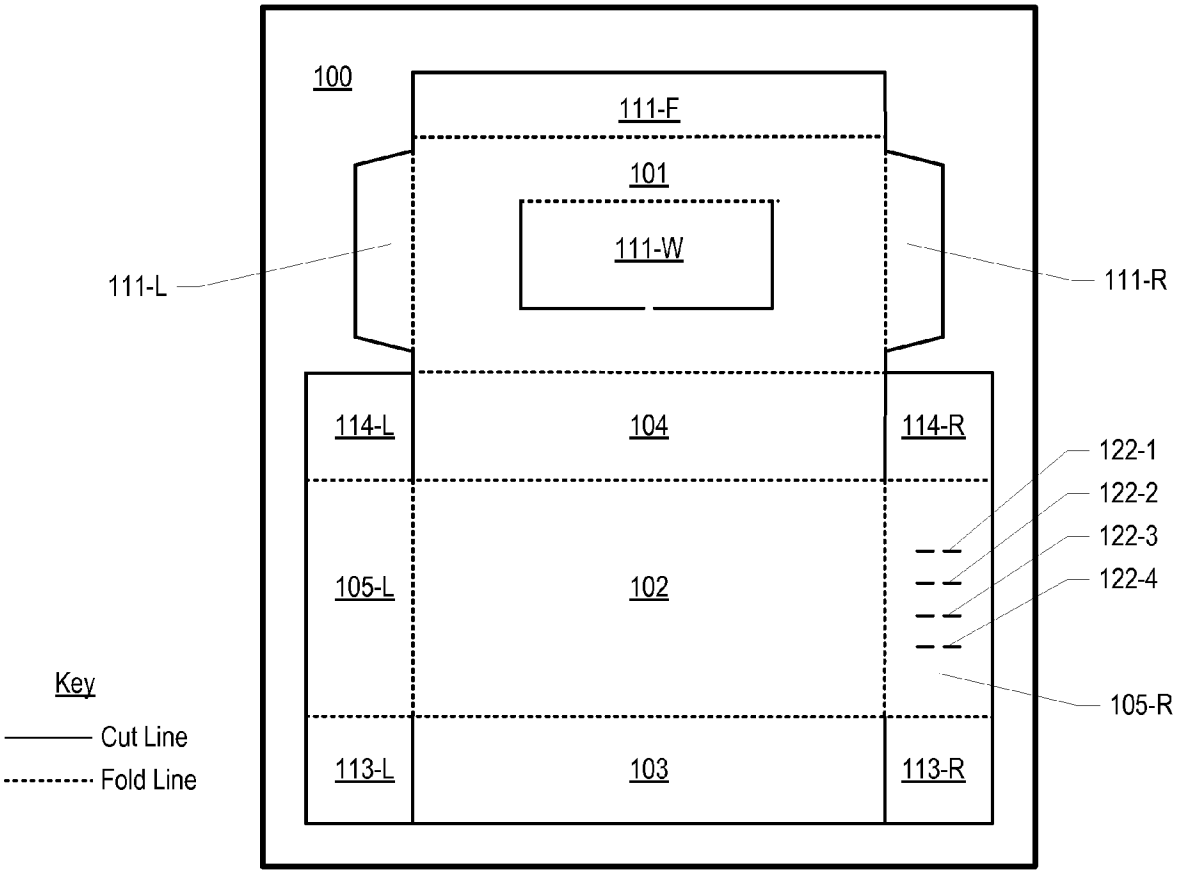
FIG. 1 depicts a plan view of the salient aspects of cardboard sheet 100 in accordance with the illustrative embodiment of the present invention.
Figure 2:
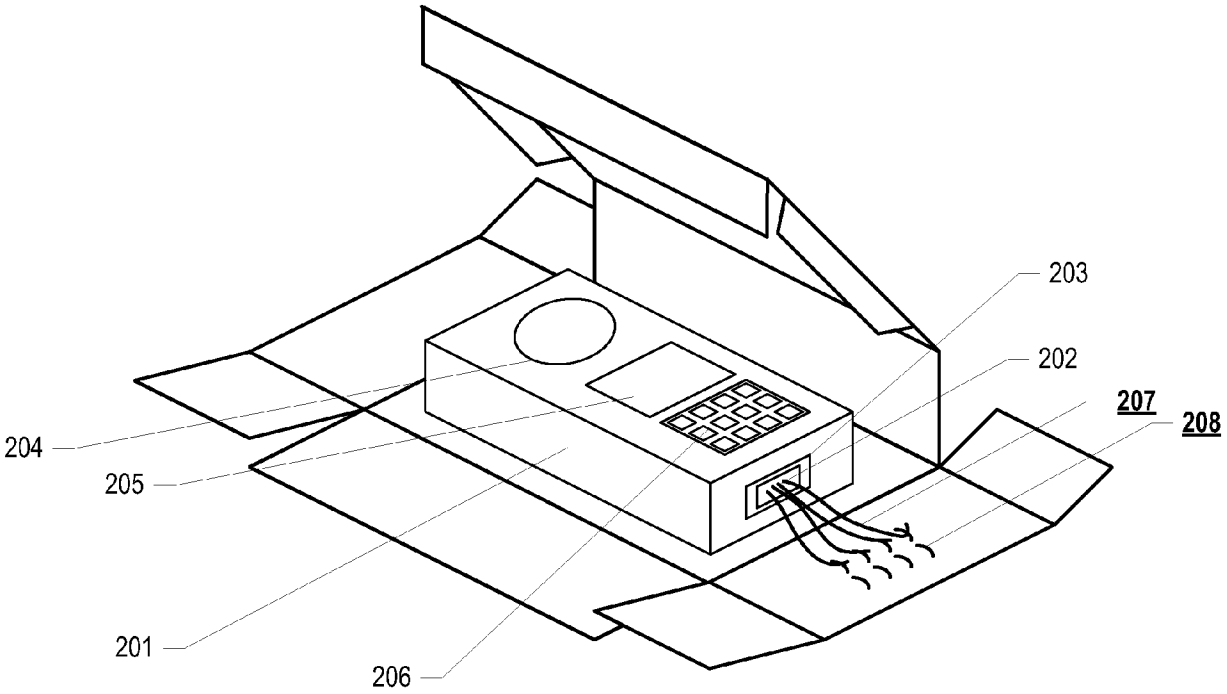
FIG. 2 depicts a drawing of the salient aspects of the semi-folded packaging as it holds electrical equipment 201.
Figure 3:
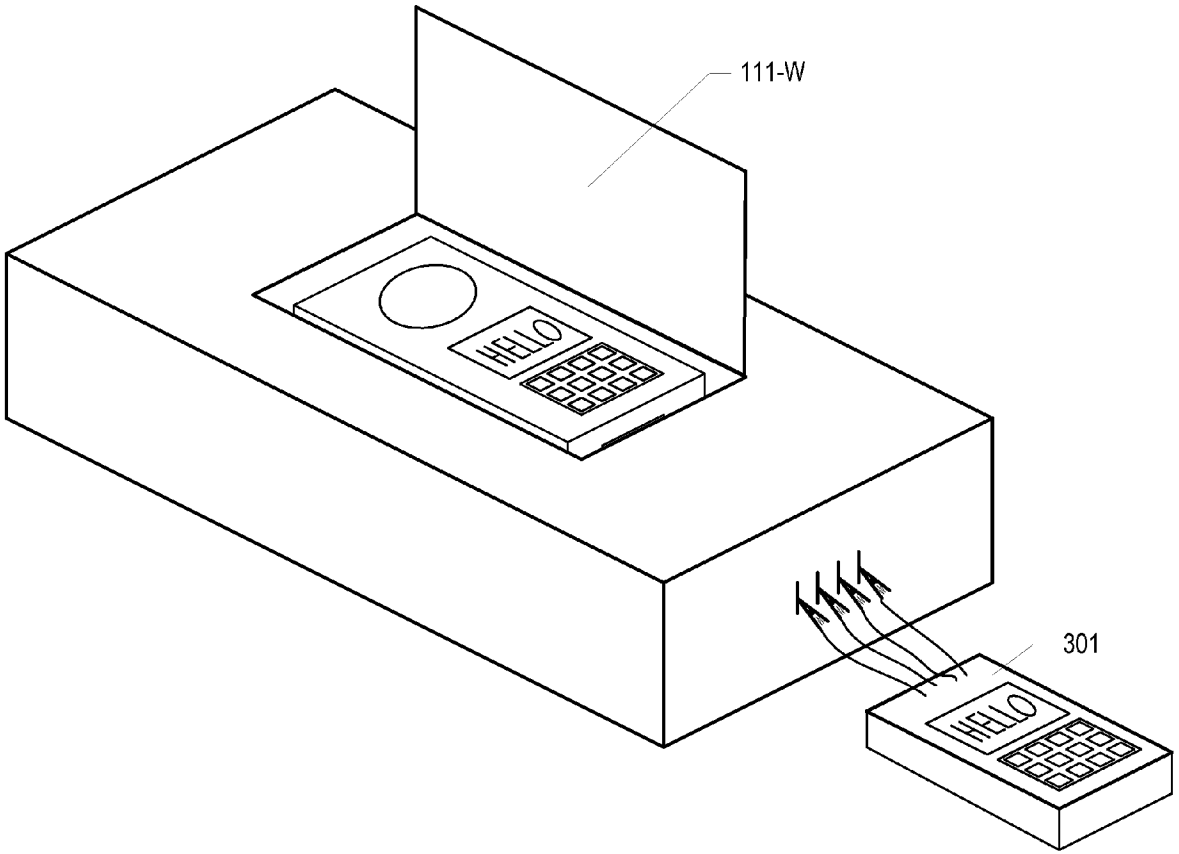
FIG. 3 depicts the salient aspects of the fully-folded packaging as it holds electrical equipment 201, which is viewable and accessible through the opening created by peeling back window tab 111-W.
Figure 4:
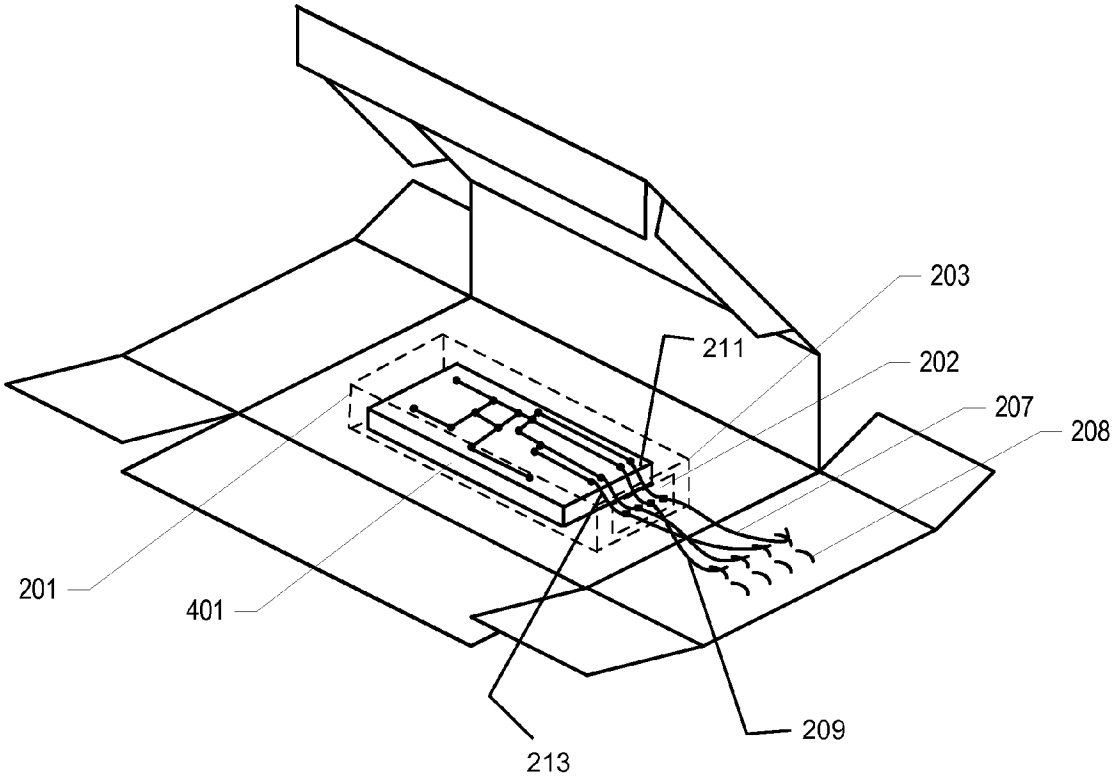
FIG. 4 depicts a drawing of the salient aspects of the semi-folded packaging as it holds electrical equipment 201 that comprises a circuit 401, wherein a wire is electrically connected to the circuit of the electrical equipment.

FIG. 1 depicts a plan view of the salient aspects of cardboard sheet 100 in accordance with the illustrative embodiment of the present invention. In accordance with the illustrative embodiment, a cardboard blank is cut from cardboard sheet 100 using a die and the cardboard blank is folded and assembled into packaging for holding electrical equipment 201 (which is not shown in FIG. 1). FIG. 2 depicts a drawing of the salient aspects of the semi-folded packaging as it holds electrical equipment 201. FIG. 3 depicts the salient aspects of the fully-folded packaging as it holds electrical equipment 201, which is viewable and accessible through the opening created by peeling back window tab 111-W.

In accordance with the illustrative embodiment, the purpose of window tab 111-W is to facilitate viewing, interacting, and/or hearing the electrical equipment within the packaging without opening the packaging. It will be clear to those skilled in the art, after reading this specification, how to make and use alternative embodiments of the present invention in which the packaging has no window for electronic equipment that can configured without the necessity of such window, or the window is fabricated from another material or materials such as Lucite, Plexiglas, cellophane, low and high density polyethylene, polyethylene teraphthalate, polypropylene, polystyrene, or other transparent or semi-transparent materials, or the window can be made with a slider, whereby the window slides open instead of folding open, or any combination of the aforementioned materials or specifications.

In accordance with the illustrative embodiment, the packaging is fabricated from cardboard, but it will be clear to those skilled in the art, after reading this specification, how to make and use alternative embodiments of the present invention in which the packaging is fabricated from another material or materials (e.g., corrugated fiberboard, paperboard, plastic, cloth, advanced composites, etc.).

The cardboard blank comprises: top 101, bottom 102, front 103, back 104, left side 105-L, and right side 105-R, which when assembled form the principal sides of the packaging. In accordance with the illustrative embodiment, the packaging has the shape of a box. It will be clear to those skilled in the art, after reading this specification, how to make and use alternative embodiments of the present invention in which the packaging has another shape (e.g., pyramid, frustum, parallelepiped, etc.).

The cardboard blank also comprises: front tab 111-F, left tab 111-L, right tab 111-R, window tab 111-W, front left tab 113-L, front right tab 113-R, back left tab 114-L, and back right tab 114-R, as shown. The purpose of front tab 111-F, left tab 111-L, right tab 111-R, front left tab 113-L, front right tab 113-R, back left tab 114-L, and back right tab 114-R is to facilitate the structural integrity of the packaging when fully assembled. In contrast, the purpose of window tab 111-W is to facilitate seeing, touching, hearing, or any combination thereof of the electrical equipment within the packaging without actually opening the packaging.

When the packaging is fully assembled:

i. front tab 111-F is parallel and adjacent to the inside of front 103, but not affixed to the inside of front 103, and ii. left tab 111-L is parallel and adjacent to the inside of left side 105-L, but not affixed to the inside of left side 105-L, and iii. right tab 111-R is parallel and adjacent to the inside of right side 105-R, but not affixed to the inside of right side 105-R, and iv. front left tab 113-L is parallel, adjacent, and securely affixed to the inside of front 103, and v. front right tab 113-R is parallel, adjacent, and securely affixed to the inside of front 103, and vi. back left tab 114-L is parallel, adjacent, and securely affixed to the inside of back 104, and vii. back right tab 114-R is parallel, adjacent, and securely affixed to the inside of back 104.

In accordance with the illustrative embodiment, the tabs that are securely affixed to the sides are affixed using stables, but it will be clear to those in the art, after reading this specification, how to make and use alternative embodiments of the present invention in which some or all of the tabs are securely affixed using another fastening technique (e.g., glue, friction, pins, tape, etc.).

Furthermore, when the packaging is fully assembled, top 101 is parallel to bottom 102 and temporarily affixed to front 103 using tape after the electrical equipment has been placed in the packaging. It will be clear to those skilled in the art, after reading this specification, how to make and use alternative embodiments of the present invention in which top 101 is affixed to front 103 using another fastening technique (e.g., glue, friction, pins, staples, etc.).

And still furthermore, when the packaging is fully assembled, window tab 111-W is co-planar with top 101 and temporarily affixed in the closed position to top 101. In accordance with the illustrative embodiment, window tab 111-W is temporarily affixed to top 101 via a small portion of uncut cardboard, but it will be clear to those in the art, after reading this specification, how to make and use alternative embodiments of the present invention in which window tab 111-W is temporarily affixed to top 101 using another fastening technique (e.g., glue, friction, pins, staples, tape, etc.).

In accordance with the illustrative embodiment, four metal electrically-conductive staples are stapled through right side 105-R as shown at locations 122-1, 122-2, 122-3, and 122-4. Although four staples are used in the illustrative embodiment, it will be clear to those skilled in the art, after reading this specification, how to make and use alternative embodiments of the present invention in which any number of staples are used. Furthermore, although all of the staples used in the illustrative embodiment are in right side 105-R, it will be clear to those skilled in the art, after reading this specification, how to make and use alternative embodiments of the present invention in which the staples are anywhere in the packaging. And still furthermore, although the illustrative embodiment uses staples, it will be clear to those skilled in the art, after reading this disclosure, how to make and use alternative embodiments of the present invention that use any kind of electrically-conductive fastener (e.g., rivets, nuts and bolts, etc.).

Referring to FIG. 2, electrical equipment 201 comprises: jack 202, speaker 204, display 205, and tactile input 206. In accordance with the illustrative embodiment, electrical equipment is a telephone, but it will be clear to those skilled in the art, after reading this disclosure, how to make and use alternative embodiments of the present invention in which electrical equipment 201 provides another function (e.g., computer, communications terminal, music/video player, etc.).

In accordance with the illustrative embodiment, the crown of each staple (208) is on the outside of the packaging whereas the legs are driven through the cardboard and bent towards each other on the inside of the packaging. It will be clear to those skilled in the art, after reading this disclosure, how to make and use alternative embodiments of the present invention in which the crown of some or all of the staples are on the inside of the packaging. Furthermore, it will be clear to those skilled in the art, after reading this disclosure, how to make and use alternative embodiments of the present invention in which the legs of some or all of the staples are bent out (i.e., "pinned").

In accordance with the illustrative embodiment, one leg of each staple structurally clutches one end of a first insulated wire (207) and a second insulated wire (209). The insulation has been removed from the wire where the staple leg clutches the wire so that the staple and the wire are electrically connected. The other end of each wire (207, 209) is connected to electric plug 202 (e.g., an RJ-11 plug, an RJ-45 plug, a USB plug, etc.), which is inserted into corresponding jack 203 in electrical equipment 201 connecting each insulated wire (207, 209) to a respective lead (211, 213).

Referring to FIG. 3, electrical equipment 201 can be tested and configured while inside the packaging by testing tool 301, which is electrically connected to the electrical equipment 201 by spring-loaded clips that attach to the crowns of the staples in the packaging. In some alternative embodiments of the present invention, electrical equipment 201 can be tested and configured while inside the packaging by placing the packaging in a spring-loaded assembly that automatically contacts the staples and makes an electrical connection between testing tool 301 and electrical equipment 201.

With window 111-W pulled back, the user of testing tool 301 can easily see, hear, and touch any portion of electrical equipment 201 while it is being tested, configured. After testing and configuration, window 111-W can be closed and sealed using, for example, clear tape.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. Packaging comprising:

a piece of cardboard;

a staple that is stapled to the piece of cardboard;

an insulated wire that is:

(i) electrically connected to the staple at a first end of the wire, and (ii) electrically connected to an electrical plug at a second end of the wire; and wherein the wire is enclosed by the piece of cardboard after being assembled into the packaging.

2. The packaging of claim 1 wherein the piece of cardboard is configured to hold an electrical equipment that comprises a circuit; and wherein the wire is electrically connected to the circuit of the electrical equipment.

3. The packaging of claim 2 wherein the piece of cardboard is configured to enable at least a portion of the electrical equipment to be seen when the piece of cardboard holds the electrical equipment.

4. The packaging of claim 2 wherein the piece of cardboard is configured to enable at least a portion of the electrical equipment to be touched when the piece of cardboard holds the electrical equipment.

5. The packaging of claim 2 wherein the piece of cardboard is configured to enable the electrical equipment to be heard when the piece of cardboard holds the electrical equipment.

6. An assembly comprising:

an electrical equipment that comprises a circuit, wherein the circuit comprises a first lead and a second lead;

a cardboard packaging that is configured to hold the electrical equipment;

a first staple that is stapled to the cardboard packaging;

a second staple that is stapled to the cardboard packaging;

a first insulated wire that electrically connects the first staple to the first lead of the circuit;

a second insulated wire that electrically connects the second staple to the second lead of the circuit; and wherein the first insulated wire is enclosed by the cardboard packaging after being assembled.

7. The packaging of claim 6 wherein the piece of cardboard is configured to enable at least a portion of the electrical equipment to be seen when the piece of cardboard holds the electrical equipment.

8. The packaging of claim 6 wherein the piece of cardboard is configured to enable at least a portion of the electrical equipment to be touched when the piece of cardboard holds the electrical equipment.

9. The packaging of claim 6 wherein the piece of cardboard is configured to enable the electrical equipment to be heard when the piece of cardboard holds the electrical equipment.

10. Packaging comprising:

a piece of cardboard having a first surface and a second surface;

a fixture that is electrically-conductive and that is affixed to the piece of cardboard such that a first portion of the fixture is on the first surface and such that a second portion of the fixture is on the second surface;

an insulated wire that is:

(i) electrically connected to the fixture at a first end of the wire, and (ii) electrically connected to an electrical plug at a second end of the wire; and wherein the wire is enclosed by the piece of cardboard after being assembled into the packaging.

11. The packaging of claim 10 wherein the piece of cardboard is configured to hold an electrical equipment that comprises a circuit; and wherein the wire is electrically connected to the circuit of the electrical equipment.

12. The packaging of claim 11 wherein the piece of cardboard is configured to enable at least a portion of the electrical equipment to be seen when the piece of cardboard holds the electrical equipment.

13. The packaging of claim 11 wherein the piece of cardboard is configured to enable at least a portion of the electrical equipment to be touched when the piece of cardboard holds the electrical equipment.

14. The packaging of claim 11 wherein the piece of cardboard is configured to enable the electrical equipment to be heard when the piece of cardboard holds the electrical equipment.

15. The packaging of claim 10 wherein said fixture is a staple.

16. The packaging of claim 10 wherein said fixture is a rivet.

* * * * *